US005726397A

United States Patent [19]

Mukai et al.

[11] Patent Number: 5,726,397

[45] Date of Patent: Mar. 10, 1998

[54] VEHICLE EXHAUST DEVICE

[75] Inventors: Teruaki Mukai; Satoshi Watanabe, both of Saitama-ken, Japan

[73] Assignee: Honda Giken Kogyo Kabushiki Kaisha, Tokyo, Japan

[21] Appl. No.: 544,366

[22] Filed: Oct. 17, 1995

[30] Foreign Application Priority Data

Oct. 19, 1994 [JP] Japan ..... 6-253658

[51] Int. Cl.[6] ..... F01N 7/02

[52] U.S. Cl. ..... 181/232; 181/249; 181/252; 181/255; 181/272

[58] Field of Search ..... 181/232, 249, 181/250, 252, 255, 256, 258, 265, 266, 269, 272, 276, 282

[56] References Cited

U.S. PATENT DOCUMENTS

| | | | |
|---|---|---|---|
| 3,317,001 | 5/1967 | Power et al. | 181/232 |
| 3,348,629 | 10/1967 | Cassel | 181/228 |
| 3,500,954 | 3/1970 | Willette | 181/228 |
| 4,909,347 | 3/1990 | Wang | 181/282 X |
| 5,245,140 | 9/1993 | Wu | 181/232 |
| 5,367,131 | 11/1994 | Bemel | 181/232 |

FOREIGN PATENT DOCUMENTS

| | | |
|---|---|---|
| 61-74620 | 5/1986 | Japan . |

*Primary Examiner*—Khanh Dang

*Attorney, Agent, or Firm*—Weiner, Carrier & Burt, P.C.; Joseph P. Carrier; Irving M. Weiner

[57] ABSTRACT

A vehicle exhaust device including a rear silencer disposed at the rear portion of a vehicle, a large-capacity silencer having a capacity larger than that of the rear silencer and disposed below a passenger compartment of the vehicle, and an intermediate silencer disposed substantially at the middle of an exhaust tube interconnecting the rear silencer and the large-capacity silencer. With the vehicle exhaust device thus arranged, exhaust noises can be attenuated at a position near an engine forming a noise source, i.e., at the early stage of transmission and with substantially reduced length-dependent resonance of the exhaust tube.

19 Claims, 6 Drawing Sheets

VEHICLE EXHAUST DEVICE

BACKGROUND OF THE INVENTION

1. Field of the Invention

The present invention relates to an exhaust device particularly suitable for vehicles, such as four-wheel automobiles.

2. Description of the Related Art

One known exhaust device is disclosed in Japanese Utility Model Laid-Open Publication No. 61-74620. The disclosed device relates to a vehicle engine exhaust system which comprises, as shown in FIG. 1 of the same Publication, a front engine 1, an exhaust manifold 3, an exhaust emission control device (not designated) incorporated in an exhaust pipe, and a large-capacity silencer 5. Stated in further detail, the exhaust emission control device is disposed below the front seat in a passenger compartment, and the large-capacity silencer 5 is disposed below the rear trunk. As used throughout the application, the term "capacity" is used to indicate volume, as undestood with reference to the drawings.

Another example of prior exhaust device is illustrated here in FIG. 8. The illustrated exhaust device 100 generally comprises, in combination, a front tube 102 extending from an engine 101 indicated by phantom lines, an exhaust emission control device 104, a middle tube 105, a small-capacity silencer 106, a flexible joint 107, a rear tube 108, a large-capacity silencer 109 and tail pipes 111 and 111.

Both of the foregoing known exhaust devices are constructed to muffle or silence noises by means of a combination of the rear large-capacity silencer with the exhaust emission control device, or with the small-capacity silencer disposed forward or upstream of the large-capacity silencer. However, since sound-deadening operation relies mainly on the rear large-capacity silencer, the muffling or sound-deadening efficiency of the prior exhaust devices is relatively low.

Furthermore, since the large-capacity silencer is far distant from a noise source, i.e. the engine, an exhaust tube interconnecting the engine and the large-capacity silencer of the first prior exhaust device, or the middle tube 105 and the rear tube 108 of the second prior exhaust device shown here in FIG. 8 are liable to expand or amplify the exhaust noises due to resonance caused depending on the length of the tubes.

As part of improved anti-pollution measures, a further reduction of the exhaust noises is needed. In view of this, there is a keen demand for the development of an exhaust device which is capable of overcome the drawbacks of the prior devices.

The present inventors have completed the invention with the view to solving the problems of the prior devices and meeting the underlying exhaust-noise-reduction requirement.

It is accordingly an object of the present invention to provide a vehicle exhaust device which is capable of controlling or suppressing the exhaust noises with high efficiency, and which has an excellent noise eliminating or muffling effect as a whole provided particularly by muffling high-energy exhaust noises generated from a portion immediately downstream of the engine over all of the low-, intermediate- and high-frequency ranges, and by reducing the length of an exhaust tube to avoid the occurrence of length-dependent resonance of the tube.

SUMMARY OF THE INVENTION

A vehicle exhaust device according to the present invention includes a rear silencer disposed at the rear portion of a vehicle, a large-capacity silencer having a capacity larger than that of the rear silencer and disposed below a passenger compartment of the vehicle, and an intermediate silencer disposed substantially at the middle of an exhaust tube interconnecting the rear silencer and the large-capacity silencer.

The large-capacity silencer is disposed adjacent to an engine of the vehicle. It is preferable that the large-capacity silencer is essentially of the expansion type, the intermediate silencer is of the sound absorption type, and the rear silencer is of the resonance type. These three silencers are arranged in series connection.

Since the large-capacity silencer is disposed near the engine, exhaust noises can be attenuated or reduced at the early stage of transmission, i.e., at a position near a noise source consisting of the engine. The series connection of the expansion type silencer, the sound absorption type silencer and the resonance type silencer enables that each silencer achieves a prescribed muffling or sound deadening operation over a specialized range of frequencies. Further, the combination of the three silencers of the different types can eventually, effectively provide a muffling or sound-deadening effect against noises generated during various modes of operations ranging from a low speed to a high speed and a low output power to a high output power of the engine.

The above and other objects, features and advantages of the present invention will become manifest to those versed in the art upon making reference to the detailed description and accompanying sheets of drawings in which a preferred structural embodiment incorporating the principles of the present invention is shown by way of illustrative example.

BRIEF DESCRIPTION OF THE DRAWINGS

In the accompanying drawings.

DETAILED DESCRIPTION

A preferred embodiment of the present invention will be described hereinbelow in greater detail with reference to the accompanying drawings.

Figure 1:
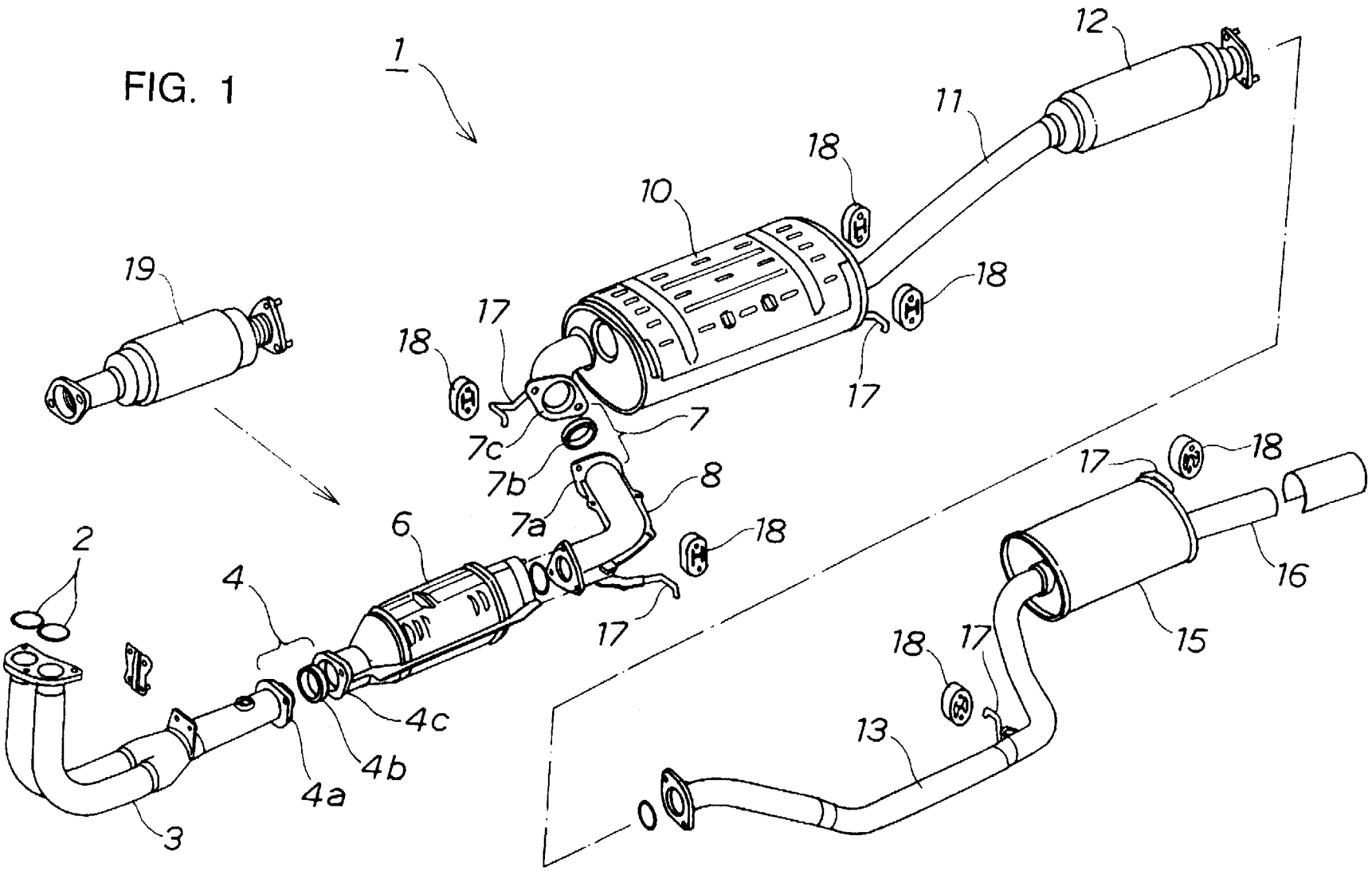
FIG. 1 is an exploded perspective view of a vehicle exhaust device according to the present invention.

Reference is initially taken to FIG. 1, which shows, in exploded perspective, a vehicle exhaust device according to the present invention. The exhaust device 1 comprises a generally L-shaped front tube 3 adapted to be attached to an exhaust manifold of a front engine (not shown) via seal rings 2, 2. The front tube 3 is bifurcated along an upstream portion and an intermediate portion thereof, the bifurcated portions being blended into a single tube along the rear portion of the front tube 3. The front tube 3 has a downstream end connected via a first spherical joint 4 to an upstream end of an exhaust emission control device 6. The first spherical joint 4 is composed of a front flange 4*a*, a spherical ring 4*b*, a rear flange 4*c* and a plurality of bolts (not shown).

The exhaust emission control device 6 has a down-stream end connected to an upstream end of an S-shaped first middle tube 8. The first middle tube 8, in the illustrated embodiment, is separable into a front portion and a rear portion which are connected together at an intermediate portion of the S-shape by means of a second spherical joint 7 composed of a front flange 7*a*, a spherical ring 7*b*, a rear flange 7*c* and a plurality of bolts (not shown).

The S-shaped first middle tube 8 has a downstream end connected to an upstream end of a large-capacity silencer 10. The downstream end of the large-capacity silencer 10 is connected to an upstream end of a second middle tube 11.

The second middle tube 11 has a downstream end connected to an upstream end of an intermediate silencer 12, the downstream end of the intermediate silencer 12 being connected to an upstream end of a rear tube 13. The rear tube 13 has a downstream end connected to an upstream end of a rear silencer 15, and a tail pipe 16 extends contiguously from a downstream end of the rear silencer 15 .

In FIG. 1, a plurality of reference numerals 17 designate hooks used in combination with a corresponding number of holders 18 to attach the aforesaid various components of the vehicle exhaust device 1 to the body of a vehicle.

A pipe unit designated by 19 in FIG. 1 is the same in size as the exhaust emission control unit 6 and used in place of the exhaust emission control unit 6 when the latter is not needed. That is, in place of the exhaust emission control unit 6, the pipe unit 19 may be disposed between the front tube 3 and the first middle tube 8.

The first spherical joint 4 is assembled such that the spherical ring 4*b* is held centrally between the front and rear flanges 4*a* and 4*c*, with the front flange 4*a* pivotally movable relative to the rear flange 4*c* within a certain angular range. Thus, the first spherical joint 4 forms a flexible tube joint. The same is true of the second spherical joint 7.

Figure 2:
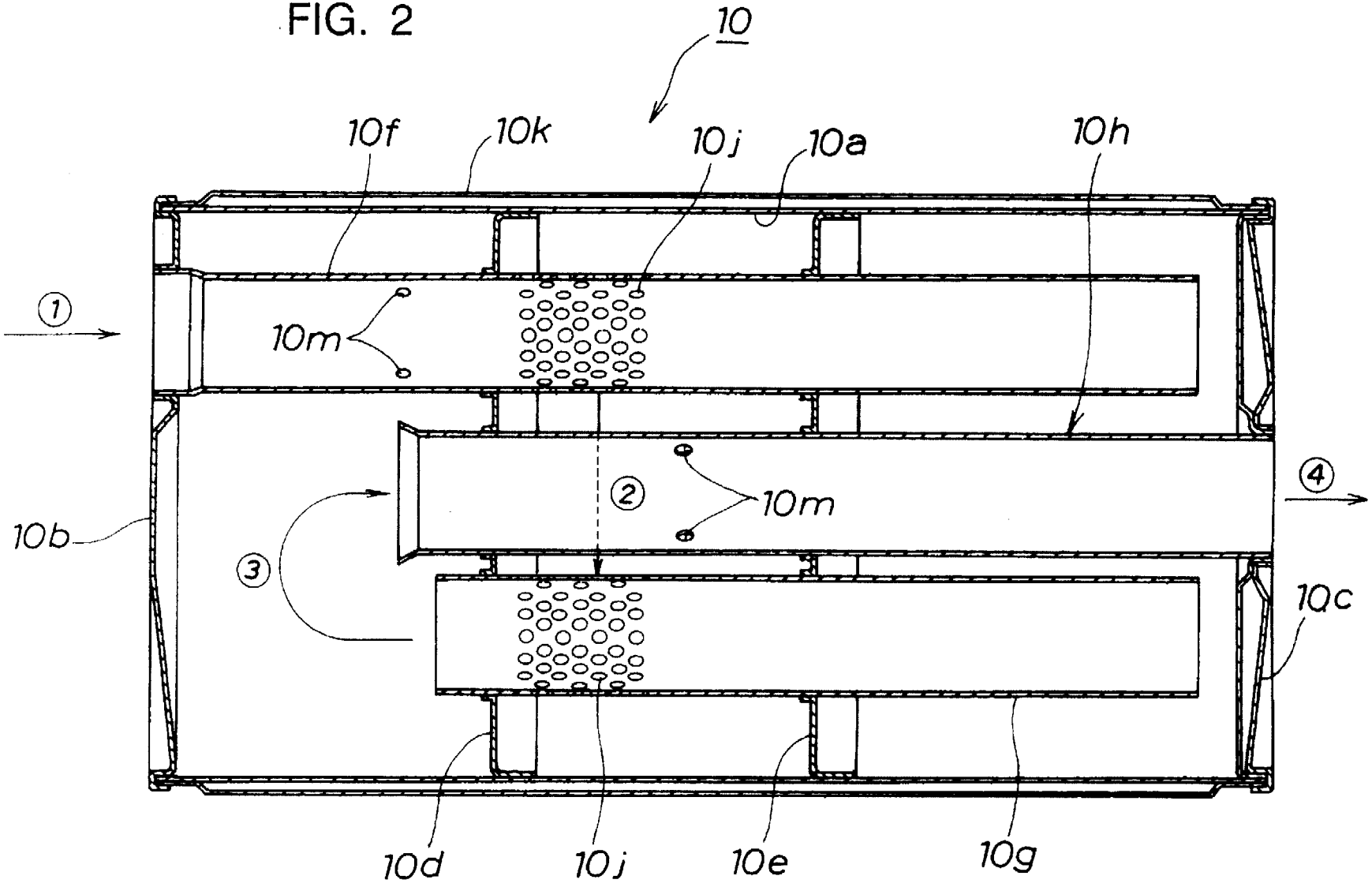
FIG. 2 is a cross-sectional view showing a large-capacity silencer of the vehicle exhaust device of the present invention.

FIG. 2 shows a cross section of the large-capacity silencer 10. The large-capacity silencer 10 has an expansion chamber and a resonance chamber and is composed of a hollow cylindrical shell 10*a* with opposite ends open, first and second end plates 10*b* and 10*c* closing the opposite open ends of the shell 10*a*, and a pair of parallel spaced partition boards 10*d* and 10*e* extending transversely across an internal space of the shell 10*a*. A first tube 10*f* is disposed in the internal space of the shell 10 and extends longitudinally of the shell 10*a* from the first end plate 10*b* toward the second end plate 10*c* successively through the two partition boards 10*d* and 10*e*, so that an upstream side of the shell 10*a* communicates with an internal space of the shell 10*a* via the first tube 10*f*. A second tube 10*g* is disposed in the internal space of the shell 10 with its opposite ends spaced from the first and second end plates 10*b*, 10*c* and extends across the thickness of the partition boards 10*d*, 10*e*. A third tube 10*h* is disposed in the internal space of the shell 10*a* and extends from the second end plate 10*c* toward the first end plate 10*b* successively through the partition boards 10*e* and 10*d*, so as to keep the internal space of the shell 10*a* in fluid communication with a downstream side of the shell 10*a*.

With the large-capacity silencer 10 thus constructed, exhaust gases are guided to flow in the direction of the arrowheads indicated by encircled numerals 1, 2, 3 and 4 in FIG. 2. During that time, the first tube 10*f* sends out or discharges the exhaust gases violently into the internal space of the shell 10*a* which has a large cross-sectional area, and the second tube 10*g* discharges the exhaust gases violently into the internal space of the shell 10*a*. Such a violent discharge of the exhaust gases causes a sudden change in the cross-sectional area of the exhaust gas flow path which brings about a significant attenuation or reduction of the acoustic energy.

A chamber defined jointly between the partition board 10*e*, the second end plate 10*c* and the shell 10*a* serves as the resonance chamber. In FIG. 2, designated by 10*m* are small holes formed in an intermediate portion of each of the first and third tubes 10*f* and 10*h* to emit sound waves into the internal space of the shell 10*a*. Numeral 10*j* denotes a number of small holes or perforations formed in each of the first and second tubes 10*f* and 10*g* for the passage of the exhaust gases. Designated by 10*k* is an outer cover extending over an outer peripheral surface of the shell 10*a*.

Figure 3:
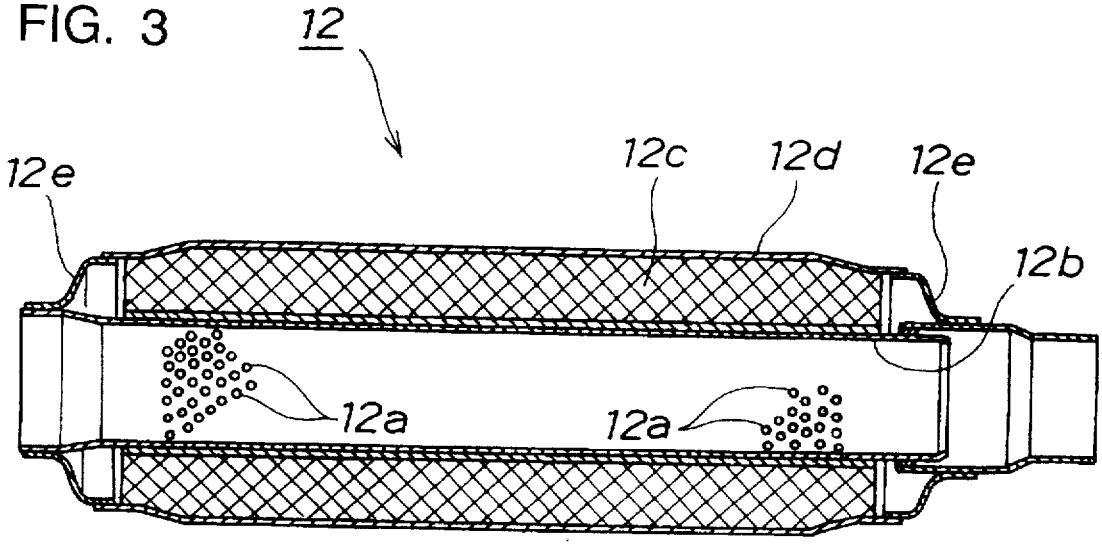
FIG. 3 is a cross-sectional view showing an intermediate silencer of the vehicle exhaust device of the present invention.

FIG. 3 shows a cross section of the intermediate silencer 12. The intermediate silencer 12 is composed of a sound absorption type silencer and includes an inner tube 12*b* having a number of small holes or perforations 12*a*, a sound insulating material 12*c* disposed around an outer peripheral surface of the perforated inner tube 12*b*, and an outer tube 12*d* surrounding the sound insulating material 12*c*. An annular space defined between the inner tube 12*b* and the outer tube 12*d* is closed by a pair of reducers 12*e*, 12*e* each attached to one end edge of the outer tube 12*d* and a corresponding one of the end edges of the outer tube 12*d* so that the sound insulating material 12*c* is sealed within the annular space. The sound insulating material 12*c* is preferably composed of a glass-wool or a stainless wire. With this arrangement, the exhaust noise is absorbed into the sound insulating material 12*c* via the perforations 12*a* with the result that a prescribed muffling or sound-deadening effect can be attained.

Figure 4:
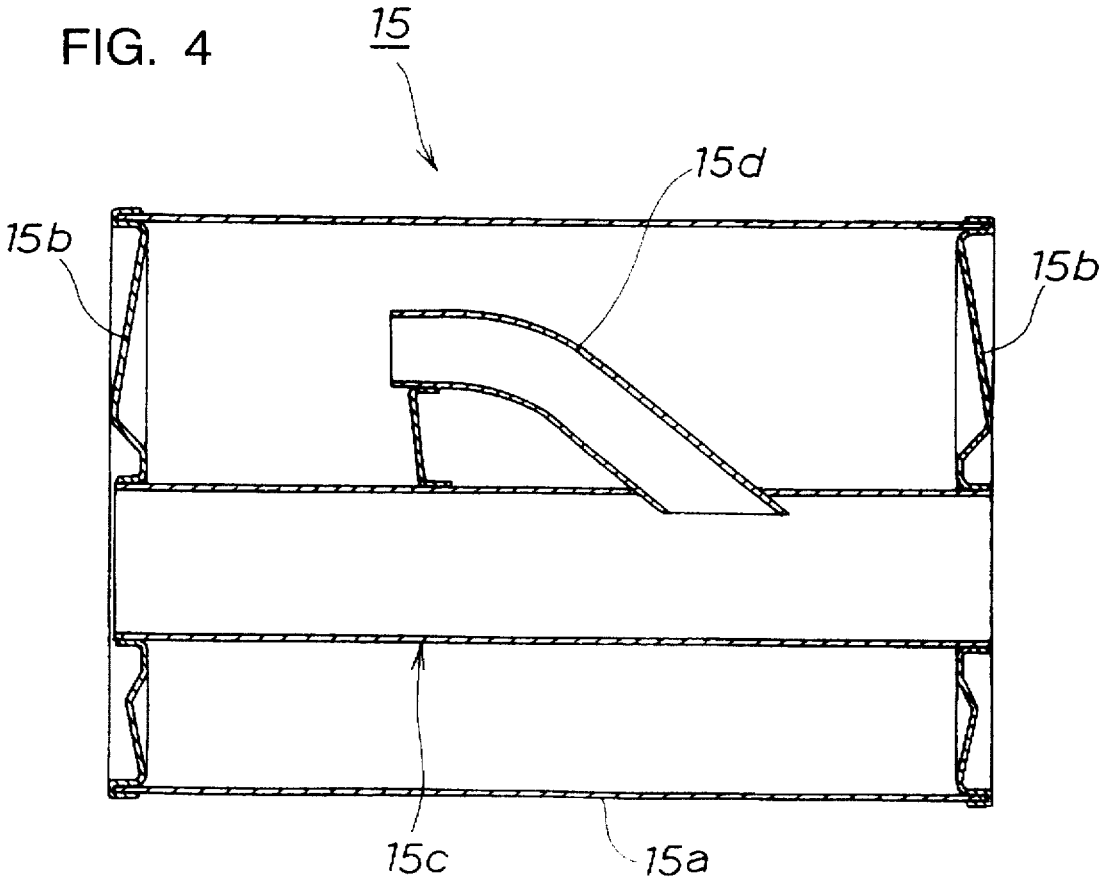
FIG. 4 is a cross-sectional view showing a rear silencer of the vehicle exhaust device of the present invention.

FIG. 4 illustrates a cross section of the rear silencer 15. The rear silencer 15 is composed of a single-chamber resonance type silencer and includes a hollow cylindrical shell 15*a*, a pair of end plates 15*b*, 15*b*, a main tube 15*c* and a branch tube 15*d* attached obliquely to an outer peripheral surface of the main tube 15*c* so as to communicate an internal space of the main tube 15*c* and an internal space or chamber 15*e* of the rear silencer 15. In the internal chamber 15*e* of the rear silencer 15, the branch tube 15*d* having one end open to the internal chamber 15*e* generates a sound wave 180° out of phase with the sound wave of a particular frequency for causing interference therebetween to eventually eliminate the sound wave of this particular frequency.

By virtue of the single chamber structure, the resonance type silencer is able to have an internal chamber of an enlarged capacity and thereby makes it possible to muffle or deaden the low frequency noises. Thus, the rear silencer 15 is advantageous for its capability of muffling or deadening noises of frequencies ranging from a low frequency to a high frequency.

Figure 5:
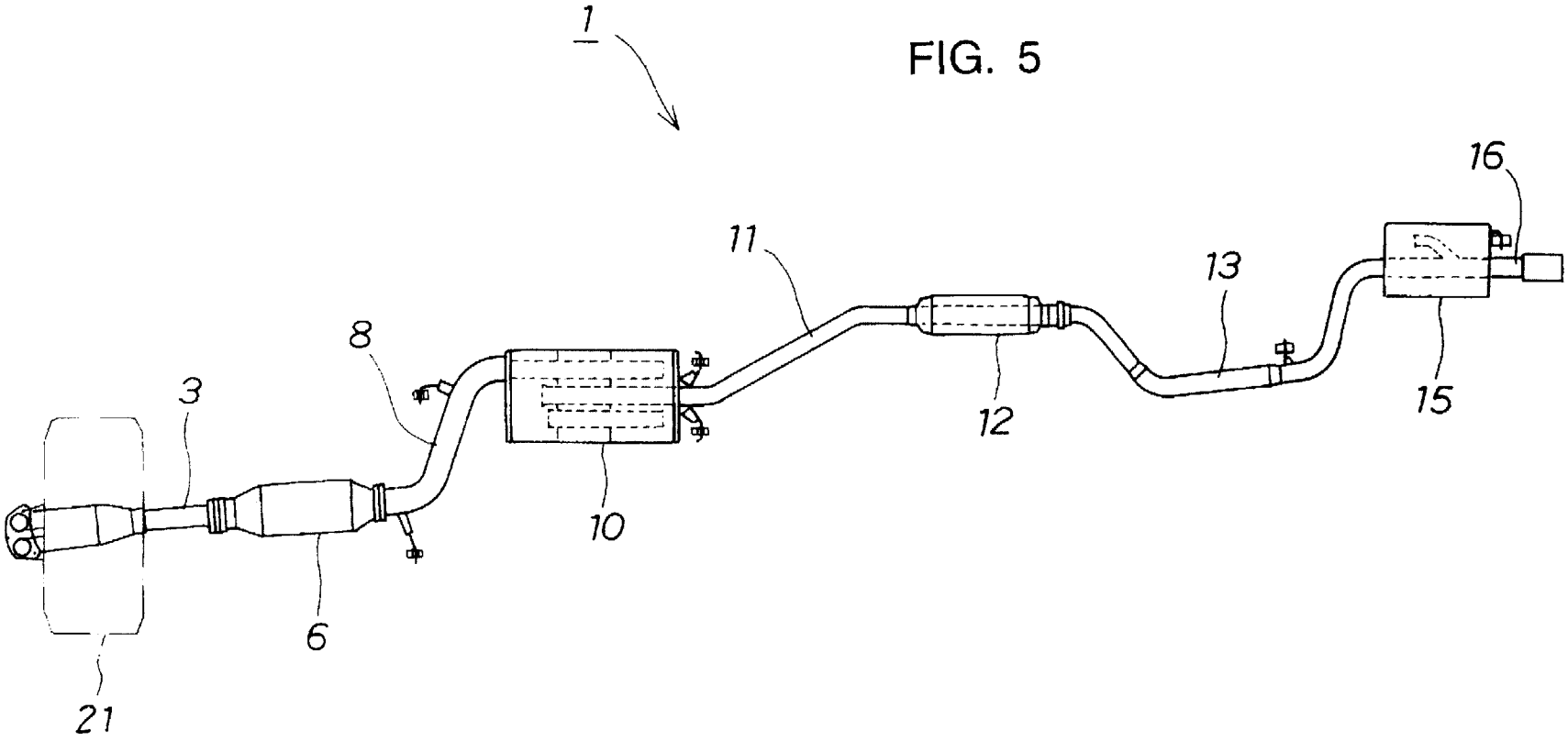
FIG. 5 is a diagrammatical plan view showing an arrangement of the vehicle exhaust device according to the present invention.

FIG. 5 shows in plan view an arrangement of the vehicle exhaust device 1 according to the present invention.

The exhaust device 1 extending rearward from the front engine 21 indicated by phantom lines is composed, as described above, of the front tube 3, the exhaust emission control device 6, the first middle tube 8, the large-capacity silencer 10, the second middle tube 11, the intermediate silencer 12, the rear tube 13, the rear silencer 15 and the tail pipe 16.

This arrangement is characterized in that the intermediate silencer 12 is disposed substantially centrally between the rear silencer 15 and the large-capacity silencer 10 disposed upstream of the rear silencer 15. With this arrangement, a conventionally used long rear tube is separated into the rear tube 13 and the second middle tube 11 both of which are about half the length of the conventional rear tube.

The foregoing vehicle exhaust device 1 operates as follows.

In FIG. 5, exhaust gases emitted from the engine 21 are purified by the exhaust emission control device 6 and subsequently flow downstream into the large-capacity silencer 10 in which a major part of the exhaust noises is deadened. The remainder of the acoustic energy of the exhaust gases is further attenuated first by the intermediate silencer 12 and subsequently by the rear silencer 15. The rear silencer 15 is an intermediate-capacity silencer and hence can effectively eliminate generation of gas-flow sound.

Furthermore, since the second middle tube 11 and the rear tube 13 are sufficiently short in length, they are free from a length-dependent resonance problem.

Stated in further detail, owing to the large-capacity silencer 10 disposed immediately downstream of the engine forming a noise source, the exhaust noises are attenuated at the early stage of transmission and hence a large noise attenuation effect can be attained.

Furthermore, since the length of the exhaust tube is reduced in half by the interposition of the intermediate silencer 12 disposed substantially centrally between the rear silencer 15 and the large-capacity silencer 10, the occurrence of a length-dependent tube-resonance problem can be avoided.

Figure 6:
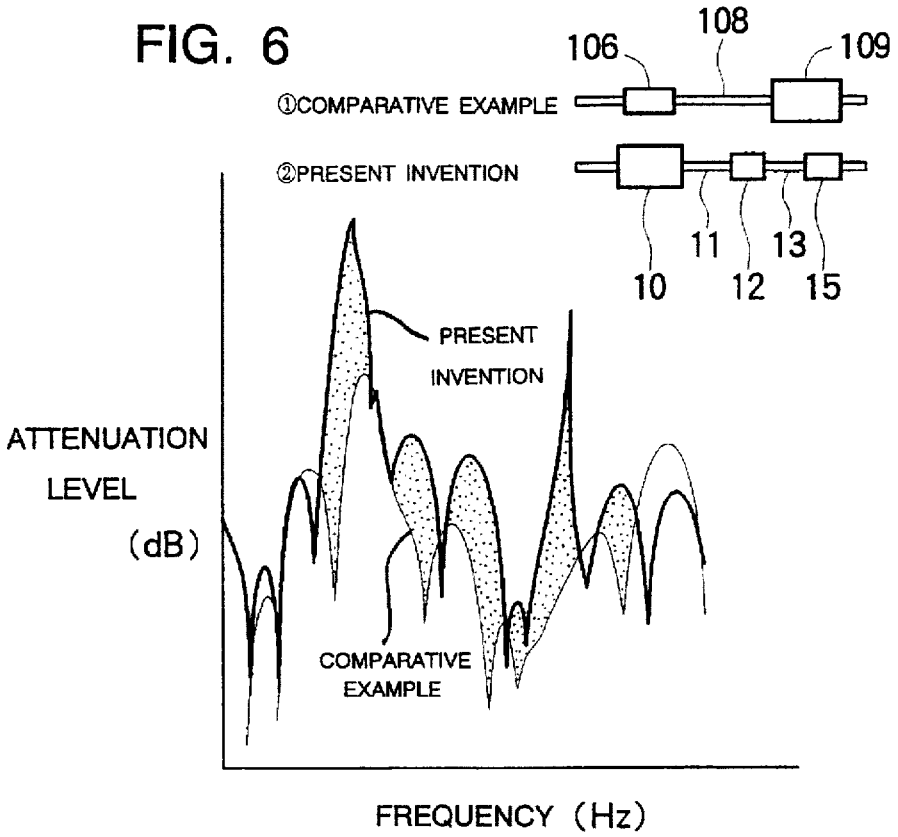
FIG. 6 is a graph showing the attenuation characteristic of the present invention as compared with that of a comparative example.

FIG. 6 graphically shows the noise attenuation characteristic of the present invention as compared with that of a comparative example. In this figure, the horizontal axis represents the frequency (Hz) and the vertical axis represents attenuation level (dB).

Figure 8:
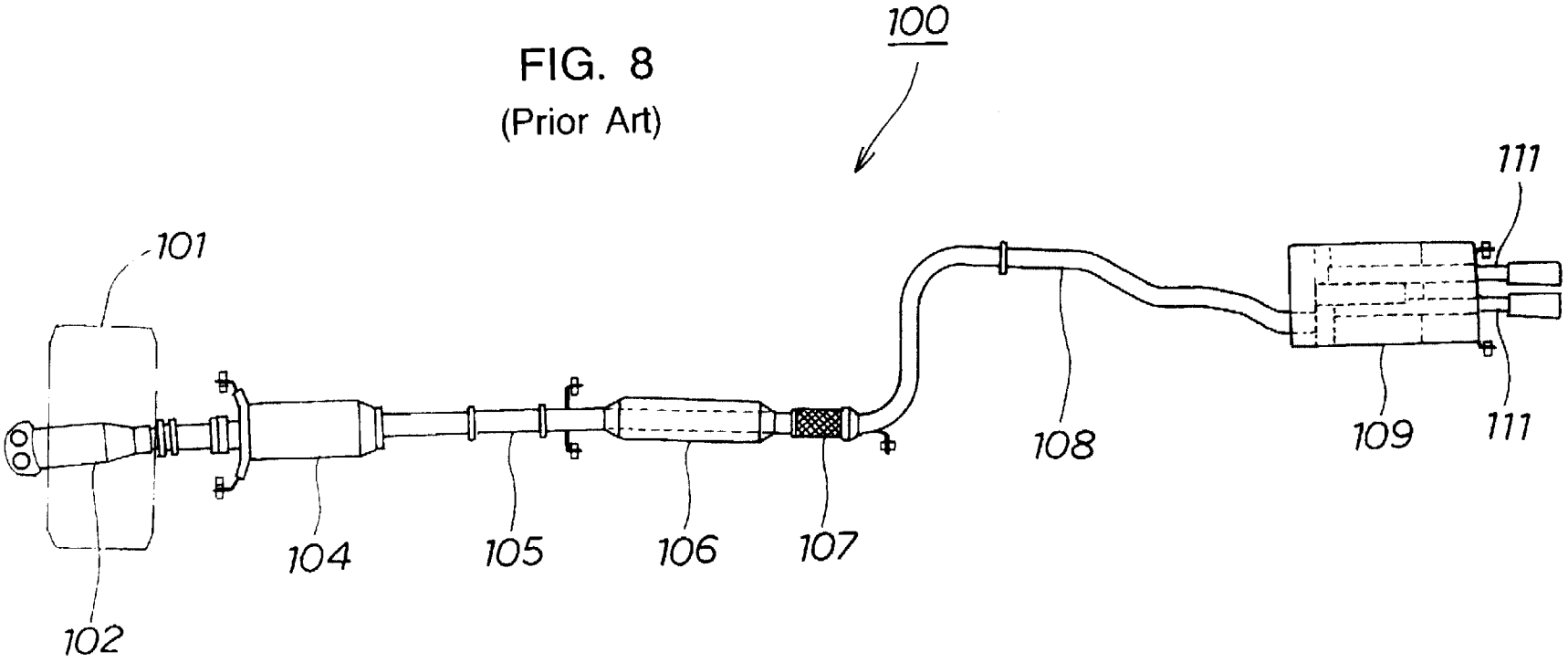
FIG. 8 (Prior Art)
FIG. 8 is a diagrammatical plan view showing the arrangement of a conventional vehicle exhaust device.

In FIG. 6, the thin solid line indicates exhaust-noise attenuation levels measured with respect to a device of the comparative example shown in the schematic diagram denoted by encircled 1 (corresponding to the device shown in FIG. 8). The thick solid line indicates exhaust-noise attenuation levels measured with respect to a device of the present invention illustrated in the schematic diagram denoted by encircled 2 (corresponding to the device shown in FIG. 5). It will be clearly understood from FIG. 6 that over most frequency ranges (as marked with small dots or points), the noise-attenuation characteristic of the device of the present invention is superior to that of the device of the comparative example.

Figure 7:
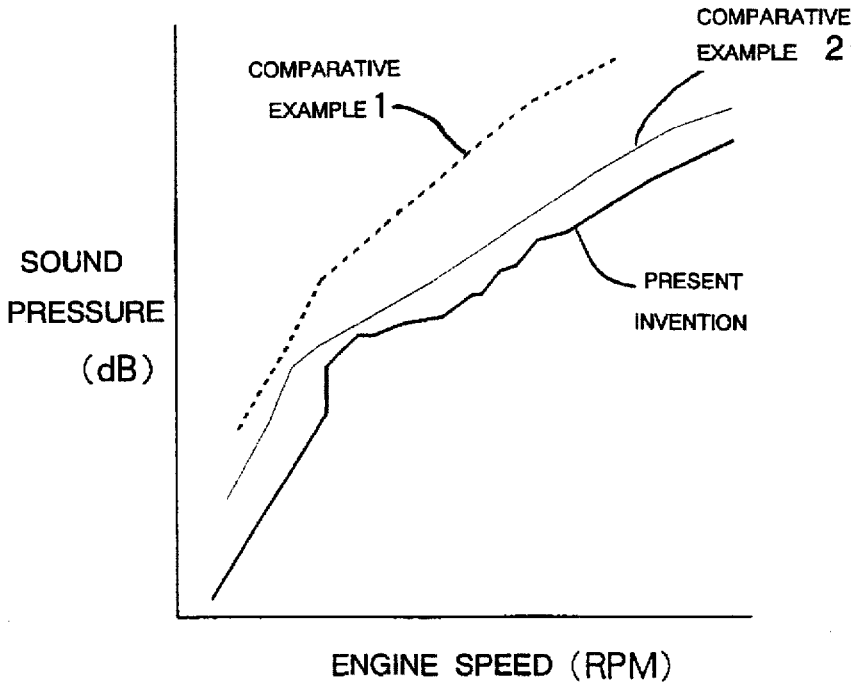
FIG. 7 is graph showing the exhaust noise of the present invention as compared with those of two comparative examples.

FIG. 7 is a graphical representation of the exhaust noises plotted for comparative purposes in respect of the device of the present invention and devices of comparative examples 1 and 2. In this figure, the horizontal axis represents the engine speed (rpm) and the vertical axis represents the sound pressure (dB). It is evident from FIG. 7 that the sound pressure of the device of the present invention indicated by the thick solid line is lower by about 5–10 dB than those of the devices of the comparative examples 1 and 2, and hence the device of the present invention can operate more quietly than the devices of the comparative examples 1 and 2.

It will be appreciated that the device of the present invention, as compared with those of the comparative examples, has a larger muffling or sound-deadening effect and hence can provide a sufficient reduction of the exhaust noises.

According to one preferred embodiment of the present invention described above, the large-capacity silencer composed of an expansion type silencer, the intermediate silencer composed of a sound absorption type silencer and the rear silencer composed of a resonance type silencer are arranged in series so that each of the silencers of the different types can undertake a prescribed muffling or sound-deadening operation in its specialized frequency range. The series-connected three silencers can, therefore, perform an effective muffling effect against noises generated during various modes of operations ranging from a low speed to a high speed of an engine as well as from a low output power to a high output power of the engine.

The expansion type silencer and the sound absorption type silencer are frequently used as vehicle silencers.

According to the present invention, however, these silencers are used in combination with the resonance type silencer.

With this combination, the rear silencer when composed of the resonance type silencer is able to provide an improved muffling or sound-deadening effect as compared with conventional combinations of the silencers.

As described above in greater detail, according to the present invention, a rear silencer is disposed at the rear portion of a vehicle, and a large-capacity silencer having a larger capacity than the rear silencer is disposed below the passenger compartment and more particularly, adjacent to an engine of the vehicle, so that exhaust noises can be attenuated at a position near a noise source consisting of the engine and hence at the early stage of transmission. Furthermore, since an intermediate silencer is disposed substantially at the middle of an exhaust tube interconnecting the rear silencer and the large-capacity silencer, the occurrence of length-dependent resonance of tube can be avoided.

The resonance type silencer disposed downstream of the large-capacity silencer can effectively deaden noises of a particular frequency range which cannot be eliminated by the large-capacity silencer.

According to the present invention, the expansion type silencer, the sound absorption type silencer and the resonance type silencer arranged in series each undertakes a prescribed muffling or sound-deadening operation in its specialized frequency range and eventually provide in combination a large muffling or sound-deadening effect against noises generated during various modes of operation ranging from a low speed to a high speed and a low output power to a high output power of the engine.

Obviously, various minor changes and modifications of the present invention are possible in the light of the above teachings. It is therefore to be understood that within the scope of the appended claims, the invention may be practiced otherwise than as specifically described.

What is claimed is:

1. An exhaust device of a vehicle having an engine and a passenger compartment, comprising:

a) a rear silencer disposed at a rear portion of the vehicle;

b) a large-volume silencer having a volume larger than that of said rear silencer and located below the passenger compartment, said large-volume silencer being disposed adjacent to the engine;

c) an exhaust tube extending from the engine and interconnecting said rear silencer and said large-volume silencer; and d) an intermediate silencer connected substantially at the middle of said exhaust tube so that length-dependent resonance of said exhaust tube is reduced.

2. An exhaust device according to claim 1, further including an exhaust emission control device connected to said exhaust tube downstream of said engine of the vehicle, wherein said large-volume silencer is disposed downstream of the engine and said exhaust emission control device.

3. An exhaust device according to claim 1, wherein said large-volume silencer is an exhaust expansion silencer.

4. An exhaust device according to claim 3, wherein said large volume silencer includes an exhaust expansion chamber and a resonance chamber therein.

5. An exhaust device according to claim 1, wherein said intermediate silencer is a sound absorption silencer.

6. An exhaust device according to claim 1, wherein said rear silencer is a single-chamber resonance silencer.

7. An exhaust device according to claim 1, wherein said large volume silencer and said intermediate silencer are interconnected by a middle tube, and said intermediate silencer and said rear silencer are interconnected by a rear tube, said middle tube and said rear tube jointly forming said exhaust tube.

8. An exhaust device according to claim 1, further including a front tube having an upstream end connected to said engine of the vehicle, an exhaust emission control unit connected to a downstream end of said front tube, a first middle tube having an upstream end connected to a downstream end of said exhaust emission control unit and a downstream end connected to an upstream end of said large-volume silencer, a second middle tube having an upstream end connected to a downstream end of said large-volume silencer and a downstream end connected to an upstream end of said intermediate silencer, a rear tube having an upstream end connected to a downstream end of said intermediate silencer and a downstream end connected to an upstream end of said rear silencer, and a tail pipe connected to a downstream end of said rear silencer, wherein said second middle tube and said rear tube jointly form said exhaust tube.

9. An exhaust device tube according to claim 8 wherein said large-volume silencer is an expansion silencer, said intermediate silencer is a sound absorption silencer, and said rear silencer is a resonance silencer, and wherein said large-volume silencer, said intermediate silencer and said rear silencer are connected in series.

10. An exhaust device according to claim 1, wherein each of said rear silencer, large-volume silencer and intermediate silencer muffles sounds over a different range of frequencies.

11. An exhaust device of a vehicle having an engine and a passenger compartment, comprising:

an exhaust tube extending from the engine;

a total of three silencers arranged in series along said exhaust tube, each of the silencers being of a different type than the other silencers, two of said silencers being connected at opposite ends of said exhaust tube, and the other of said silencers being connected substantially at the middle of said exhaust tube;

one of said silencers having a larger volume than that of the other silencers and is disposed closest to the engine.

12. An exhaust device according to claim 11, wherein said one of said silencers disposed closest to the engine of the vehicle is a large-volume, exhaust expansion type silencer.

13. An exhaust device according to claim 11, wherein said one of said silencers is a large-volume silencer and is disposed below the passenger compartment of the vehicle.

14. An exhaust device according to claim 11, further including an exhaust emission control device connected downstream of the engine of the vehicle and upstream of said three silencers.

15. An exhaust device according to claim 11, wherein one of said silencers is an exhaust expansion silencer, another of said silencers is a sound-absorption silencer, and a third of said silencers is a single-chamber resonance silencer.

16. An exhaust device according to claim 15, wherein said exhaust expansion silencer is the larger volume silencer disposed closest to the engine of a vehicle, said single room resonance silencer is disposed at a rear end of said exhaust tube, and said sound absorption silencer is the silencer connected at the middle of said exhaust tube.

17. An exhaust device according to claim 11, wherein each of said three silencers muffles sounds over a different specialized range of frequencies.

18. An exhaust device of a vehicle having a passenger compartment, comprising:

a rear silencer disposed at a rear portion of the vehicle;

a large-volume silencer having a volume larger than that of said rear silencer and disposed below the passenger compartment; and exhaust tube means for interconnecting said rear silencer and said large-volume silencer is series, said exhaust tube means including a plurality of tube sections interconnected together so as to reduce length-dependent resonance of the exhaust tube means, and said exhaust tube means further including an intermediate silencer connecting said plurality of tube sections.

19. An exhaust device according to claim 18, wherein each of said rear silencer, large-volume silencer and intermediate silencer muffles sounds over a different range of frequencies.

* * * * *

UNITED STATES PATENT AND TRADEMARK OFFICE

CERTIFICATE OF CORRECTION

PATENT NO. : 5,726,397

DATED : 10 March 1998

INVENTOR(S) : Teruaki Mukai, Satoshi Watanabe

It is certified that error appears in the above-identified patent and that said Letters Patent is hereby corrected as shown below:

Title page,
item [56], under "References Cited", change "Power et al." to --Powers et al.--.

Column 1, line 19, change "undestood" to --understood--;
line 48, change "overcome" to --overcoming--.

Column 2, line numbered between 54 and 55, before "graph" insert --a--.

Column 6, line 37, before "tube" insert --the--.

Column 7, line 12, change "large volume" to --large-volume--;
line 19, change "large volume" to --large-volume--.

Column 8, line 40, change "is" to --in--.

Signed and Sealed this

Twenty-sixth Day of May, 1998

*Attest:*

*Attesting Officer*

Bruce Lehman

BRUCE LEHMAN

*Commissioner of Patents and Trademarks*